United States Patent [19]

Buck

[11] 4,133,995

[45] Jan. 9, 1979

[54] METHOD OF FIRE DETECTION IN A MICROWAVE OVEN

[75] Inventor: Ronald G. Buck, Burnsville, Minn.

[73] Assignee: Litton Systems, Inc., Beverly Hills, Calif.

[21] Appl. No.: 829,079

[22] Filed: Aug. 30, 1977

[51] Int. Cl.[2] ..... H05B 9/06

[52] U.S. Cl. ..... 219/10.55 M; 219/10.55 B; 219/510

[58] Field of Search ..... 219/10.55 B, 10.55 R, 219/10.55 C, 494, 499, 510; 340/227 R, 227 D, 228 R; 426/241, 242, 243; 236/44 C, DIG. 8

[56] References Cited

U.S. PATENT DOCUMENTS

| | | | |
|---|---|---|---|
| 3,566,079 | 2/1971 | O'Neil | 219/494 X |
| 3,829,649 | 8/1974 | Igarashi | 219/10.55 B |
| 3,839,616 | 10/1974 | Risman | 219/10.55 B |
| 3,875,361 | 4/1975 | Fukui et al. | 219/10.55 B |
| 3,903,395 | 9/1975 | Hamstra | 219/494 X |
| 3,949,607 | 4/1976 | Nodolf | 236/44 C |
| 3,999,027 | 12/1976 | Moore | 219/10.55 B |
| 4,009,359 | 2/1977 | Tallmadge et al. | 219/10.55 B |
| 4,011,428 | 3/1977 | Fosnough et al. | 219/10.55 B |
| 4,056,708 | 11/1977 | Soodak et al. | 219/499 |
| 4,080,564 | 3/1978 | Nitta et al. | 219/10.55 B |

FOREIGN PATENT DOCUMENTS

| | | | |
|---|---|---|---|
| 2312067 | 12/1976 | France | 219/10.55 B |
| 2462165 | 4/1976 | Fed. Rep. of Germany | 219/10.55 B |

*Primary Examiner*—Arthur T. Grimley
*Attorney, Agent, or Firm*—Robert E. Lowe

[57] ABSTRACT

A method for detecting a fire in a microwave oven heating cavity by sensing the time dependent "in-situ" humidity and the temperature environmental conditions of a microwave oven heating cavity in a microwave oven. The humidity sensor and the temperature sensor connect to a programmable controller in the microwave oven. When the sensed "in-situ" relative humidity decreases and the sensed temperature increases within a predetermined time interval, there is a fire in the cavity. The programmable controller processing the sampled humidity and temperature signal information turns off the microwave oven upon sensing the decreasing humidity and increasing temperature within the predetermined time interval indicating a fire.

8 Claims, 1 Drawing Figure

METHOD OF FIRE DETECTION IN A MICROWAVE OVEN

BACKGROUND OF THE INVENTION

1. Field of the Invention

The present invention relates generally to improvements in a microwave oven, and more particularly, pertains to a new and improved method of fire detection in a microwave oven heating cavity.

2. Description of the Prior Art

Those concerned with the development of microwave ovens have long recognized the need for an accurate method of fire detection in a microwave oven heating cavity. The present invention fills this need.

Past devices have filed to accurately determine a fire condition in a microwave oven heating cavity. While microwave ovens cook with "cool" microwave energy, sometimes it occurs that a cook will let a particular food cook longer than required or fail to turn the microwave oven off, thereby causing the food to overheat and combust resulting in a fire condition in the microwave oven heating cavity.

Smoke sensors cannot be located in the duct connecting the microwave oven heating cavity to the outside environment, as such sensors would be unsatisfactory due to dynamic gas flow within the duct system and the time lag taking the smoke to travel from the microwave oven cavity through the duct system to the point at which the sensor senses the smoke. Also, it has been impossible to locate fire sensors directly in the microwave oven heating cavity to electromagnetic interference consideration.

This invention, method of fire detection in a microwave oven, overcomes these disadvantages by providing an accurate and responsive sensing system of the time dependent "in-situ" environmental conditions of the microwave oven heating cavity when a fire occurs.

SUMMARY OF THE INVENTION

The present invention obviates the foregoing disadvantages of the prior art by providing a method of fire detection in a microwave oven to sense the time dependent "in-situ" environmental conditions when a fire occurs in the microwave oven heating cavity. The time dependent "in-situ" environmental conditions are defined as the sensed humidity and temperature conditions of the microwave oven heating cavity by humidity and temperature sensors.

According to the preferred embodiment of the present invention, there is provided a method of fire detection in a microwave oven having the steps of sensing time dependent "in-situ" humidity and temperature environmental conditions of a microwave oven heating cavity in a microwave oven, monitoring the humidity for a substantial decrease in sensed value and monitoring the temperature for a substantial increase in sensed value over a predetermined time, and turning off the microwave oven if the humidity decrease and temperature increase conditions occur within the predetermined time interval indicating a fire.

A significant aspect and feature of the present invention is a method for fire detection in a microwave oven within a matter of seconds after a fire occurs in the microwave oven heating cavity. By monitoring the "in-situ" environmental conditions of the microwave heating cavity with a humidity sensor and a temperature sensor, a fire can be detected in minimal time due to the change of the time dependent "in-situ" environmental conditions.

Having briefly described the preferred embodiment of the invention, it is a principal object to provide a new and improved method of fire detection in a microwave oven heating cavity.

An object of the present invention is to provide an accurate method for detecting a fire in a microwave oven heating cavity.

Another object of the present invention is to sense the "in-situ" environmental conditions of the microwave oven heating cavity by positioning sensors at an exit ventilation port which input the sensed "in-situ" environmental conditions to a programmable controller which determines when a fire exists within the microwave oven heating cavity. The term "in-situ" as used in this application is defined as the actual time dependent environmental conditions which exist in the environment surrounding the food product which is located in and cooked in the microwave oven heating cavity. Although in the present invention, a humidity sensor and a temperature sensor may be positioned outside of the microwave oven heating cavity, the sensors are configured to sense the "in-situ" environmental conditions of the microwave oven heating cavity and provide "in-situ" signal information of the environmental conditions of the microwave oven heating cavity to a programmable controller controlling the microwave oven.

BRIEF DESCRIPTION OF THE DRAWINGS

Other objects and many of the attendant advantages of this invention will be readily appreciated as the same becomes better understood by reference to the following detailed description when considered in connection with the accompanying drawing in which like reference numerals designate like elements throughout the figure thereof and wherein.

DESCRIPTION OF THE PREFERRED EMBODIMENT

Figure 1:
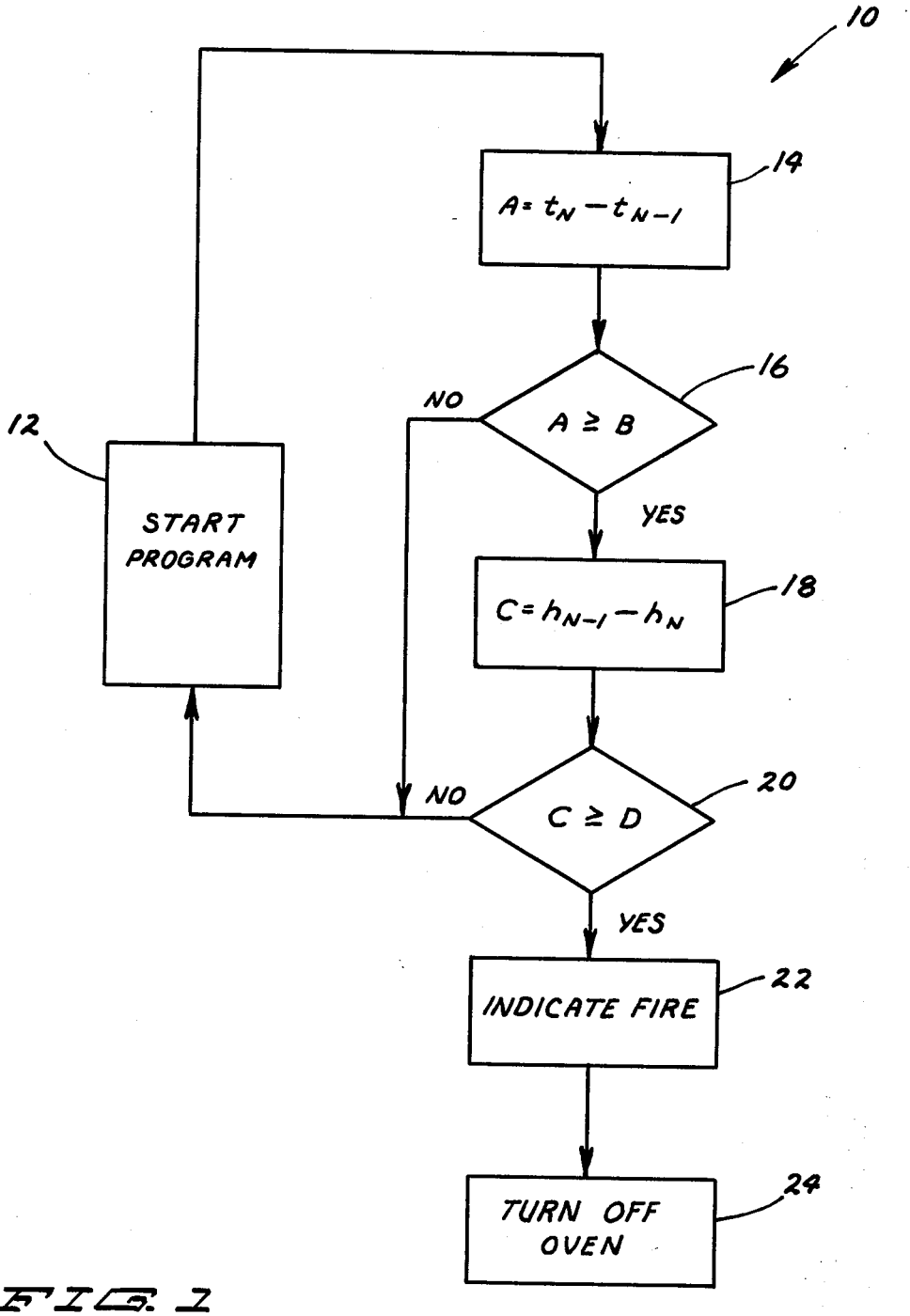
FIG. 1 illustrates a flow chart of the steps for the method of fire detection in a microwave oven cavity in accordance with the present invention.

FIG. 1 illustrates a flow chart 10 of the steps of a method of fire detection in a microwave oven cavity in accordance with the present invention. The method is commenced by starting the program at 12. First, a previously sensed temperature at time $t_{n-1}$ is subtracted from the sensed temperature 14 at time $t_n$ to determine if the difference A is greater to or equal to a predetermined value B 16. If a NO condition exists, the program restarts itself at 12. If a YES condition exists, then the sensed humidity at time $t_n$ is subtracted from the previous sensed humidity 18 at time $t_{n-1}$ to determine if the difference C is greater than or equal to a predetermined value D 20. If a NO condition exists with the difference C of humidity 18 being less than or equal to a predetermined value D 20, the program restarts itself at 12. If a YES condition exists where C is greater than or equal to the predetermined value D, then an indicate fire 22 followed by a turn-off oven 24 results.

Preferred Mode of Operation

The method for fire detection in a microwave oven can be implemented in accordance with the flow chart 10 of the figure as an algorithm stored in a programmable controller such as an Intel 8080 Microprocessor of the microwave oven. This algorithm detects the point in time at which a fire occurs in the microwave oven heating cavity. In implementation, the difference in temperature rise would be between 10 to 20° C. while the difference in the humidity would be between 10 to 20% of the sensed relative humidity over a predetermined time interval of ten to thirty seconds.

An aluminum oxide humidity sensor, such as a Thunder Scientific TC-2000 Humidity Measurement Module, and a temperature sensor such as a National Semiconductor Corporation LX 5700 temperature transducer are positioned adjacent to and by the exit ventilation port for way of example and purposes of illustration only on the exterior side of the microwave oven heating cavity and connect to the programmable controller to input the sensed and sampled values of humidity and temperature respectively. The sensors are positioned to sense the time dependent "in-situ" environmental conditions of the microwave oven heating cavity and are electromagnetically protected from the microwave oven heating cavity. The programmable controller connects to the microwave power source power supply and to the air exchange control circuit to indicate a fire 22 and turn off the oven 24 when a fire is detected.

The basic premise of the method as shown in the figure is to detect a point in time where the sampled and sensed "in-situ" temperature is increasing at a rapid rate for a predetermined value and a sampled and sensed "in-situ" humidity is decreasing at a rapid rate for a predetermined time value. Over the time interval these two conditions occur, there is an indication that a fire 22 exists and the oven is turned off, 24. In turning off the oven 24, the microwave power source control circuit and the air exchange control circuit are disabled when the oven is turned off at condition 24.

The first step of the method of the algorithm of FIG. 1 is to subtract the previous sampled and sensed "in-situ" temperature from the present sampled and sensed "in-situ" temperature 14 to determine if the difference A is greater than or equal to some predetermined value B at 16 in the flow chart. This predetermined value for increasing temperature is the range of 10° to 20° C. If the temperature condition 16 is satisfied, then the sampled and sensed "in-situ" humidity is subtracted from the previous sampled and sensed "in-situ" humidity 18 to see if the difference C is greater than or equal to some predetermined value D at 20 in the flow chart. This predetermined value for decreasing changing humidity is the range of 10 to 20% relative humidity.

In practical situations when a fire occurs in a microwave oven heating cavity such as by the cook overheating the foods, the humidity takes an abrupt decrease and the temperature takes an abrupt increase over a very short time, measured in a matter of a few seconds. A predetermined time interval is a range of ten to thirty seconds for the humidity to decrease and the temperature to increase for way of example and purposes of illustration only. By monitoring both the sampled and sensed "in-situ" humidity and temperature environmental conditions over a predetermined interval of time a fire is detected in the microwave oven heating cavity.

Various modifications are contemplated in the method of fire detection in a microwave and may obviously be resorted to by those skilled in the art without departing from the apparent scope of the invention as hereinafter defined by the appended claims as only a preferred embodiment thereof has been disclosed.

Having thus described the invention, there is claimed as new and desired to be secured by Letters Patent:

1. A method of fire detection in a microwave oven comprising the steps of:

a. comparing a sampled and sensed in-situ temperature with a previous sampled and sensed in-situ temperature of a microwave oven heating cavity;

b. comparing a sampled and sensed in-situ previous relative humidity with a sampled and sensed in situ relative humidity of said microwave oven heating cavity;

c. indicating that a fire exists when said sampled and sensed temperature is increasing and said sampled and sensed relative humidity is decreasing, and;

d. turning off the oven.

2. The method according to claim 1 comprising the step of:

a. said increasing temperature and said decreasing relative humidity occuring within a predetermined time interval.

3. The method according to claim 1 comprising the step of:

a. turning off a microwave power source coupling microwave energy to said microwave oven heating cavity when a fire is indicated.

4. The method according to claim 1 comprising the step of:

a. turning off a air exchange control circulating air through said microwave oven heating cavity when a fire is indicated.

5. The method according to claim 1 comprising the step of:

a. measuring a decrease of said in-situ relative humidity of 10 to 20%.

6. The method according to claim 1 comprising the step of:

a. measuring an increase of said in-situ temperature of ten to twenty degrees centigrade.

7. The method according to claim 2 comprising the step of:

a. said predetermined time interval being ten seconds.

8. The method according to claim 2 comprising the step of:

a. said predetermined time interval being a range of ten to thirty seconds.

* * * * *